US011920250B2

(12) United States Patent
Camacho Chico et al.

(10) Patent No.: US 11,920,250 B2
(45) Date of Patent: Mar. 5, 2024

(54) RECOVERY OF RARE EARTH METALS AND OTHER METALS FROM NATURAL LIQUID SOURCES BY ELECTRODIALYSIS METATHESIS

(71) Applicants: Lucy Mar Camacho Chico, Corpus Christi, TX (US); Mohammad U. Shafiq, Montgomery, TX (US)

(72) Inventors: Lucy Mar Camacho Chico, Corpus Christi, TX (US); Mohammad U. Shafiq, Montgomery, TX (US)

(73) Assignee: The Texas A&M University System, College Station, TX (US)

( * ) Notice: Subject to any disclaimer, the term of this patent is extended or adjusted under 35 U.S.C. 154(b) by 0 days.

(21) Appl. No.: 17/868,060

(22) Filed: Jul. 19, 2022

(65) Prior Publication Data

US 2022/0349077 A1 Nov. 3, 2022

Related U.S. Application Data

(63) Continuation of application No. 17/079,346, filed on Oct. 23, 2020, now abandoned.

(51) Int. Cl.
*C25C 1/00* (2006.01)
*C25C 1/22* (2006.01)

(52) U.S. Cl.
CPC ..... *C25C 1/22* (2013.01)

(58) Field of Classification Search
CPC ..... C25C 1/22
See application file for complete search history.

(56) References Cited

U.S. PATENT DOCUMENTS

2009/0123751 A1* 5/2009 Horiguchi ..... B01D 61/44 205/555
2015/0274562 A1* 10/2015 Batstone ..... B01D 61/44 204/632
2019/0046927 A1* 2/2019 Bhikhi ..... B01D 61/50
2020/0324249 A1* 10/2020 Li ..... C02F 1/4693

* cited by examiner

*Primary Examiner* — Zulmariam Mendez
(74) *Attorney, Agent, or Firm* — Benjamin Aaron Adler

(57) ABSTRACT

Provided herein is an electrodialysis metathesis system that has at least one stack or quad of compartments arranged so each compartment is in fluid communication with its adjacent compartment via alternating cation- and anion-exchange membranes. The compartments in a stack are a feed compartment, a substitution salt solution compartment, a first concentrated compartment and a second concentrated compartment. Also provided are processes and methods for separating or recovering a metal, for example, a rare earth element, or a salt or a combination thereof from a salt-containing water. Simultaneous metathesis reactions and electrodialysis across the stack recovers one or more metal or salts from the salt-containing water which desalinates the salt-containing water.

16 Claims, 4 Drawing Sheets

RECOVERY OF RARE EARTH METALS AND OTHER METALS FROM NATURAL LIQUID SOURCES BY ELECTRODIALYSIS METATHESIS

CROSS-REFERENCE TO RELATED APPLICATIONS

This application is a continuation of pending non-provisional application U.S. Ser. No. 17/079,346, filed Oct. 23, 2020, the entirety of which is hereby incorporated by reference.

FEDERAL FUNDING LEGEND

This invention was made with support under Grant Number 1632146 awarded by the National Science Foundation. The government has certain rights in the invention.

BACKGROUND OF THE INVENTION

Field of the Invention

The present invention relates generally to the fields of electrochemistry, hydrometallurgy, rare earth elements (REE), and all other metals from the Periodic Table of the Elements. More specifically, the present invention is directed to a process utilizing electrodialysis metathesis (EDM) and chemical reactions to precipitate and recover the rare earth elements, metals and desalinated water from natural liquid sources.

Description of the Related Art

REE are considered energy critical elements (ECE) which shortage could significantly inhibit large-scale deployment of energy-related technologies with potential to transform the production, transmission, storage, and conservation of energy, including photovoltaic solar cells, wind turbines, and hybrid automobiles. Providing a feasible alternative to access REE from otherwise unaccessible REE-rich sources, such as geothermal water, will ensure REE into the supply chain.

Traditional Electrodialysis (ED) is made of two compartments, which doesn't prevent the precipitation of salts inside of the stack, making the ED process inefficient. Separation of REE by concentration is not possible with the ED process. Only the introduction of a metathesis reaction to the electrodialysis process makes it possible the REE enrichment and further precipitation of the REE and metals in the form of salts. To the knowledge of the inventor, there is no technology capable of recovering REE from geothermal water. Very little research have been conducted on the recovery of REE from natural liquid sources, such as geothermal water, or even seawater, or any other type of salty water containing REE. Current methods for REE recovery are based on flotation of pulverized ore, as well as acid or alkaline mining from natural solid sources. These processes use acid to leach out the REE out of the mines into solution or alkaline solutions to create a REE rich cake which is later put into acid baths to remove the REE. There is an untapped resource of REE in geothermal water. The present invention will make it possible to access REE from these sources. The EDM process has been patented to desalinate and recover minerals with zero discharge desalination from seawater and brackish water. The use of EDM to recover REE and metals from geothermal water with zero discharge desalination is presented for the first time in this invention.

Thus, there is a recognized need for processes and systems to access and to recover rare earth elements (REE) from otherwise unaccessible REE-rich sources. Specifically, the prior art is deficient in a process and system that combines electrodialysis metathesis (EDM) and chemical reactions to recover rare earth elements from geothermal water. The present invention fulfills this longstanding need and desire in the art.

SUMMARY OF THE INVENTION

The present invention is directed to an electrodialysis metathesis (EDM) system. The system comprises at least one electrodialysis stack of four compartments where each is in fluid communication with its adjacent compartment via alternating cation- and anion-exchange membranes. The compartments comprise a feed compartment to receive a salt-containing water, a substitution solution compartment containing a substitution salt solution, a first concentrated compartment, and a second concentrated compartment.

The present invention also is directed to a process for separating a metal of interest from a salt-containing water. In the process applying an electric field is applied across the electrodialysis metathesis (EDM) system as described herein thereby producing in the first concentrated compartment a first concentrate of a salt composed of cations from the substitution salt solution and anions from the salt-containing water and producing in the second concentrated compartment a second concentrate of a salt composed of metal cations and other cations from the salt-containing water and anions from the substitute salt solution. The first concentrate and the second concentrate are removed from the EDM system and combined to produce a combined concentrate. The pH of the combined concentrate is adjusted to precipitate the metal of interest.

The present invention is directed to a related process for separating a metal of interest from a salt-containing water comprising a further step of sequentially readjusting the pH of the combined concentrate to selectively precipitate other metals or salts. The present invention is directed to another related process further comprising recovering the metals or salts. The present invention is directed to yet another related process further comprising recovering desalinated water from the feed cell.

The present invention is directed further to a process for recovering a rare-earth element of interest from a salt-containing water. In the process the salt-containing water is fed into the feed compartment of the electrodialysis metathesis system described herein. An electric field is applied across the EDM system to initiate an exchange of cations and anions in the salt-containing water with cations and anions in the substitution salt solution via a metathesis reaction. The substitution salt solution cations and the salt-containing water anions are concentrated in the first concentrated compartment and the salt-containing water REE cations and other cations and the substitution salt anions are concentrated in the second concentrated compartment via electrodialysis. The cations and anions in the first concentrated compartment are combined with the cations and anions in the second concentrated compartment as a combined concentrate and the pH of the combined concentrate is adjusted to precipitate the rare-earth element of interest. The rare earth element is recovered from the combined concentrate.

The present invention is directed to a related process for recovering a rare-earth element of interest from a salt-containing water comprising further steps of selectively readjusting the pH of the combined concentrate to sequentially precipitate other rare earth elements and recovering the other rare earth elements from the combined concentrate. The present invention is directed to another related process further comprising recovering desalinated water from the feed cell.

The present invention is directed further still to a method for a simultaneous recovery of at least one rare earth element from and desalinization of a geothermal water. In the method the geothermal water is fed into the feed compartment of the electrodialysis metathesis system described herein. An electric field is applied across the EDM system to move all cations in the substitution salt solution and all anions in the geothermal water to the first concentrated compartment and the rare earth element cations and all other cations in the geothermal water and all anions in the substitution salt solution to the second concentrated compartment, the geothermal water desalinated thereby. The cations and anions are removed from the first concentrated compartment and from the second concentrated compartment and are combined as a combined concentrate. The pH is adjusted to selectively precipitate at least one of the rare earth elements in the combined concentrate, thereby recovering the rare earth element.

The present invention is directed to a related method for a simultaneous recovery of at least one rare earth element from and desalinization of a geothermal water further comprising selectively readjusting the pH of the combined concentrate to sequentially precipitate other rare earth elements. The present invention is directed to another related method further comprising recovering the desalinated geothermal water from the feed cell.

Other and further aspects, features, benefits, and advantages of the present invention will be apparent from the following description of the presently preferred embodiments of the invention given for the purpose of disclosure.

BRIEF DESCRIPTION OF THE DRAWINGS

So that the matter in which the above-recited features, advantages and objects of the invention, as well as others that will become clear, are attained and can be understood in detail, more particular descriptions of the invention briefly summarized above may be had by reference to certain embodiments thereof that are illustrated in the appended drawings. These drawings form a part of the specification. It is to be noted, however, that the appended drawings illustrate preferred embodiments of the invention and therefore are not to be considered limiting in their scope.

DETAILED DESCRIPTION OF THE PRESENT INVENTION

Figure 1:
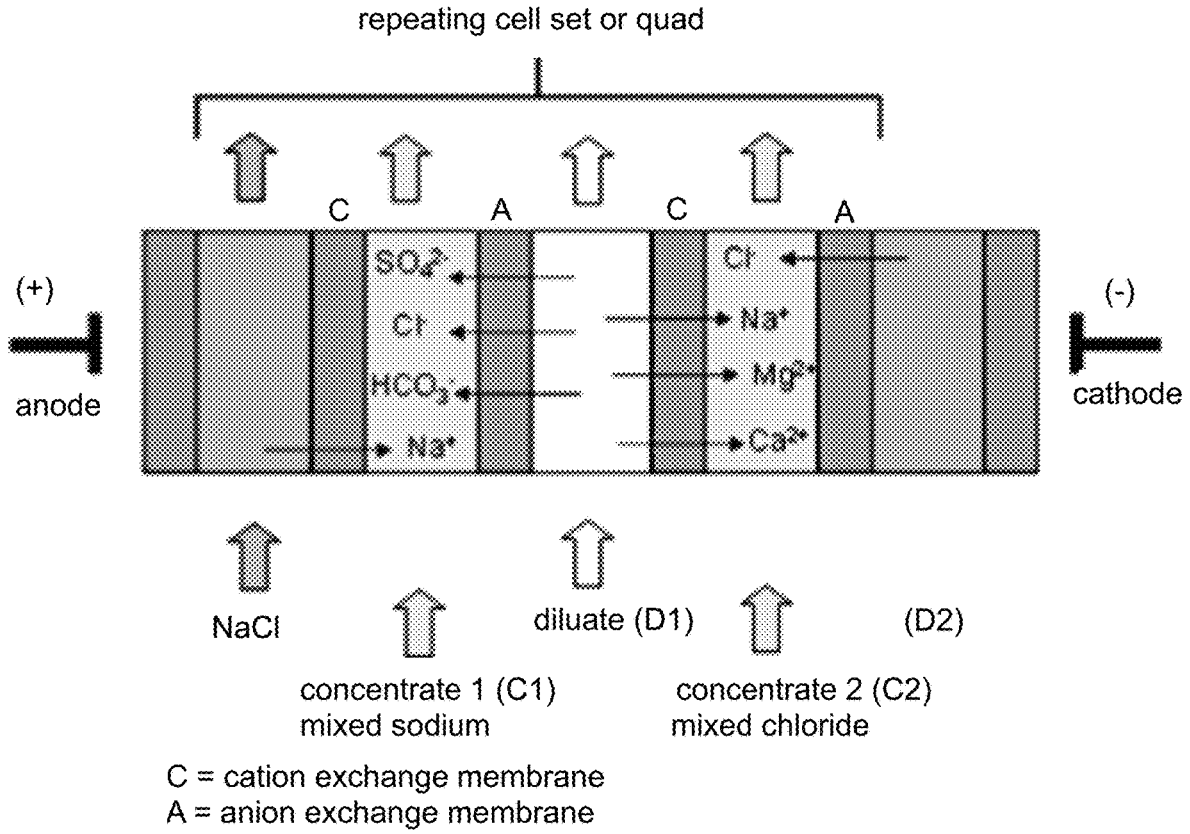
FIG. 1 shows the stack or quad in the electrodialysis metathesis (EDM) system.

The articles "a" and "an" when used in conjunction with the term "comprising" in the claims and/or the specification, may refer to "one", but is also consistent with the meaning of "one or more", "at least one", and "one or more than one". Some embodiments of the invention may consist of or consist essentially of one or more elements, components, method steps, and/or methods of the invention. It is contemplated that any composition, component or method described herein can be implemented with respect to any other composition, component or method described herein.

The term "or" in the claims refers to "and/or" unless explicitly indicated to refer to alternatives only or the alternatives are mutually exclusive, although the disclosure supports a definition that refers to only alternatives and "and/or".

The terms "comprise" and "comprising" are used in the inclusive, open sense, meaning that additional elements may be included.

The term "including" is used herein to mean "including, but not limited to". "Including" and "including but not limited to" are used interchangeably.

As used herein, the term "about" refers to a numeric value, including, for example, whole numbers, fractions, and percentages, whether or not explicitly indicated. The term "about" generally refers to a range of numerical values (e.g., +/−5-10% of the recited value) that one of ordinary skill in the art would consider equivalent to the recited value (e.g., having the same function or result). In some instances, the term "about" may include numerical values that are rounded to the nearest significant figure.

As used herein, the term "electrodialysis metathesis" or "EDM" refers to the incorporation of a metathesis reaction within a conventional electrodialysis (ED) process.

As used herein, the term "metathesis" refers to the interchange of cations and anions between two salts in the electrodialysis metathesis process.

As used herein, the terms "Periodic Table of the Elements" and "periodic table" are used interchangeably.

As used herein, the term "metal" refers to any metal element, metalloid element and/or rare earth element or rare earth metal as known in the art and identified in the periodic table.

In one embodiment of the present invention, there is provided an electrodialysis metathesis (EDM) system comprising at least one electrodialysis stack of four compartments, each in fluid communication with its adjacent compartment via alternating cation- and anion-exchange membranes, said compartments comprising a feed compartment to receive a salt-containing water; a substitution solution compartment containing a substitution salt solution; a first concentrated compartment; and a second concentrated compartment. In this embodiment the substitution salt solution comprises a salt or a hydroxide or other solution combination of elements from the Periodic Table of the Elements compatible with a metathesis reaction with a rare earth element or other metal or metalloid. Representative examples of the substitution salt solution may be a sodium chloride solution, a sodium carbonate solution, a sodium sulfate solution, a sodium hydroxide solution, or a sodium phosphate solution.

In another embodiment of the present invention, there is provided a process for separating a metal of interest from a salt-containing water comprising applying an electric field across the EDM system of as described supra thereby producing in the first concentrated compartment a first concentrate of a salt composed of cations from the substitution salt solution and anions from the salt-containing water and to produce in the second concentrated compartment a second concentrate of a salt composed of metal cations and other cations from the salt-containing water and anions from the substitute salt solution; removing the first concentrate and the second concentrate from the EDM system and combining the same to produce a combined concentrate; and adjusting pH of the combined concentrate to precipitate the metal of interest.

Further to this embodiment the process comprises sequentially readjusting the pH of the combined concentrate to selectively precipitate other metals or salts. In another further embodiment the method comprises recovering the metals or salts. In yet another further embodiment the first concentrate and the second concentrate simultaneously desalinates the salt-containing water in the feed cell, where the method comprises recovering the desalinated water from the feed cell.

In all embodiments the metal of interest may be a rare earth element or metalloid present in the Periodic Table of the Elements. Also in all embodiments the rare-earth element is lanthanum, cerium or europium, or a combination thereof. In addition the salt-containing water may be from a geothermal source, is a seawater, a brackish water, a produced water, a hyper-saline water, is a solution generated from rare earth element-rich ores, or a processed natural liquid from naturally occurring rare earth elements and metal sources, or a combination thereof.

In yet another embodiment of the present invention there is provided a process for recovering a rare-earth element of interest from a salt-containing water, comprising feeding the salt-containing water into the feed compartment of the electrodialysis metathesis system as described supra; applying an electric field across the EDM system to initiate an exchange of cations and anions in the salt-containing water with cations and anions in the substitution salt solution via a metathesis reaction; concentrating the substitution salt solution cations and the salt-containing water anions in the first concentrated compartment and the salt-containing water REE cations and other cations and the substitution salt solution anions in the second concentrated compartment via electrodialysis metathesis; combining the cations and anions in the first concentrated compartment with the cations and anions in the second concentrated compartment as a combined concentrate; adjusting pH of the combined concentrate to precipitate the rare-earth elements of interest; and recovering the rare earth element from the combined concentrate. Further to this embodiment the method comprises selectively readjusting the pH of the combined concentrate to sequentially precipitate other rare earth elements contained therein; and recovering the other rare earth elements from the combined concentrate. In another further embodiment the concentrating step simultaneously desalinates the salt-containing water to produce a desalinated water in the feed cell where the method comprises recovering the desalinated water from the feed cell.

In all embodiments the rare-earth element may be lanthanum, cerium or europium, or a combination thereof. Also in both embodiments the salt-containing water may be from a geothermal source, is a seawater, a brackish water, a produced water, a hyper-saline water, is a solution generated from rare earth element-rich ores, or a processed natural liquid from naturally occurring rare earth elements and metal sources or a combination thereof.

In yet another embodiment of the present invention there is provided a method for a simultaneous recovery of at least one rare earth element from and desalinization of a geothermal water, comprising feeding the geothermal water into the feed compartment of the electrodialysis metathesis system as described supra; applying an electric field across the EDM system to move all cations in the substitution salt solution and all anions in the geothermal water to the first concentrated compartment and the rare earth element cations and all other cations in the geothermal water and all anions in the substitution salt solution to the second concentrated compartment, said geothermal water desalinated thereby; removing the cations and anions from the first concentrated compartment and from the second concentrated compartment and combining the same as a combined concentrate; and adjusting pH to selectively precipitate at least one of the rare earth elements in the combined concentrate, thereby recovering the rare earth element.

Further to this embodiment the method comprises selectively readjusting the pH of the combined concentrate to sequentially precipitate other rare earth elements. In another further embodiment the method comprises recovering the desalinated geothermal water from the feed cell. In all embodiments the rare-earth element may be lanthanum, cerium or europium, or other rare-earth element present in the Periodic Table of the Elements or a combination thereof.

Provided herein are electrodialysis metathesis (EDM) processes, methods and a system to recover rare earth elements and other metals and metalloids and enabling zero discharge desalination. The process or method and system utilizes a combination of ion-exchange membranes and electrical current in a stack or quad of four compartments. A representative example of an EDM system comprises a feed compartment, a substitution solution compartment containing a substitution salt solution, a first concentrated compartment and a second concentrated compartment. The substitution salt solution may be a solution comprising any salt or hydroxide or combination of elements from the periodic table suitable for or compatible with the metathesis reaction with a rare earth element or other metal or metalloid from the periodic table. Representative examples are, but are not limited to, sodium chloride, sodium carbonate, sodium sulfate, sodium hydroxide, or sodium phosphate.

In the stack or quad a metathesis reaction takes place to selectively separate, the REE and other metal or metalloid elements in the periodic table by, for example, but not limited to, adjustment of pH. This prevents the precipitation of undesirable chemical compounds inside of the EDM stack. Particularly, rare earth elements recoverable via the EDM process are energy-critical elements, such as, but not limited to lanthanum, cerium and europium.

The REE solution may be pretreated by filtration or left untreated prior to entering the EDM system. The EDM process generates a permeate or desalinated water stream with high quality and two concentrated streams or a first concentrate and a second concentrate. Each concentrated stream is unique and rich in strategically selected ions. The two concentrated streams are combined outside of the EDM stack to form a combined concentrate and engineered to selectively precipitate and recover the REE and metal salts, and enabling zero discharge desalination. The desalinated water or other natural liquid source may be recovered.

The process recovers rare earth elements and metals and metalloids from any natural liquid source or salt-containing water or a combination thereof. Non-limiting examples are geothermal water, sea water, or other liquids or fluids from a geothermal source, brackish water, such as brackish groundwater, produced water, a hyper-saline (highly salty) water a solution generated from rare earth element-rich ores, or a processed natural liquid from naturally occurring REE and metal sources.

The following examples are given for the purpose of illustrating various embodiments of the invention and are not meant to limit the present invention in any fashion.

Example 1

Electrodialysis Methathesis System

The EDM system comprises repeating cells of alternating cation- and anion-exchange membranes in the electrodialysis stack, i.e., quads, and a substitution solution of $Cl^-$, $SO_4^{2-}$, $NO_3^-$, or $PO_4^{3-}$ salts) (FIG. 1). Every quad contains two diluted compartments (D1 and D2) and two concentrated compartments (C1 and C2). D1 contains the feed solution and D2 contains the substitution solution. When electrical potential or an electric field is applied, the metathesis reaction causes the ions from the feed solution to exchange with ions from the substitution solution. The exchanged ions are then selectively transferred through the cation- and anion-exchange membranes towards the C1 and C2. In these two compartments the targeted elements become concentrated. This process enables double decomposition reactions of the ions present in the solution with the purpose of converting insoluble salt into new soluble salts. The process also enables the selective concentrate of ions in separated compartments to prevent early precipitation of elements during the separation process. Once outside of the EDM stack, the concentrated solutions are combined with pH adjustment to have sequential precipitation of targeted elements.

Example 2

Metathesis Reaction: Sodium Chloride and Calcium

Figure 2A:
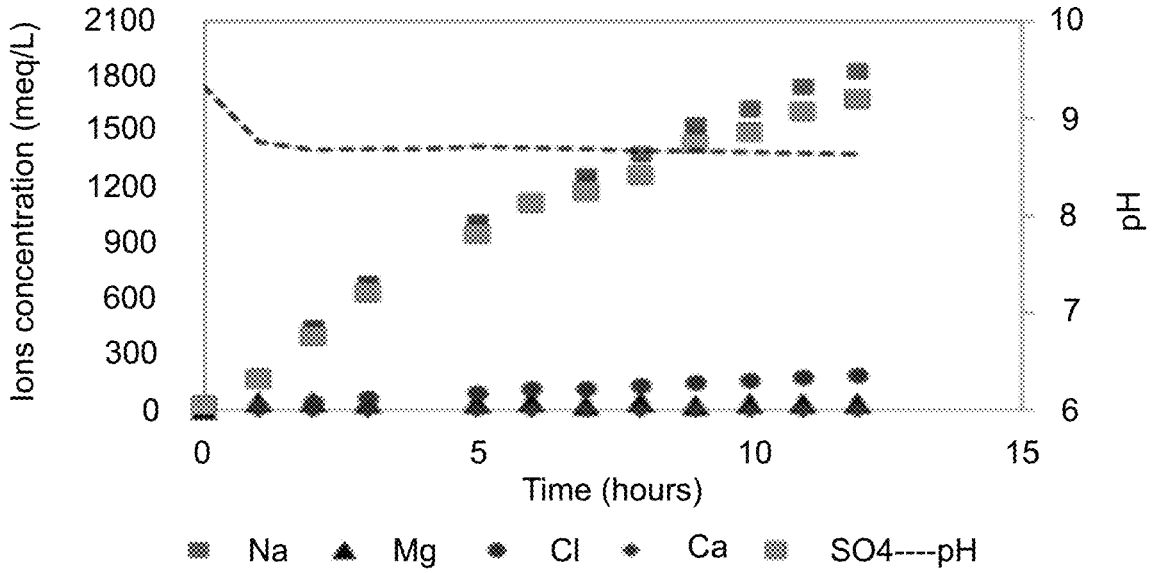
FIGS. 2A-2B show the change of ions concentrations and pH during the metathesis reaction in the EDM process in a mixed-sodium stream (FIG. 2A) and in a mixed-chloride stream (FIG. 2B).
Figure 2B:
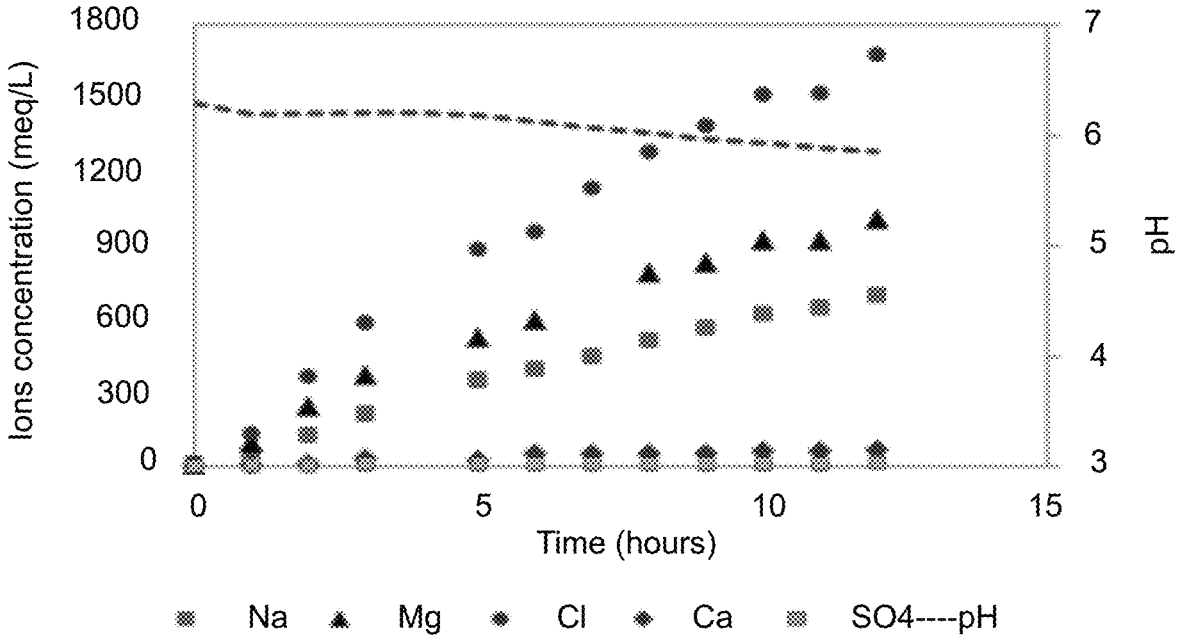

The selective separation of ions by the metathesis reaction of sodium chloride and calcium from simulated brackish groundwater in the EDM process is shown in FIGS. 2A-2B. The mixed sodium compartment (C1) accumulates soluble NaCl and $Na_2SO_4$ salts (FIG. 2A). The mixed chloride compartment (C2) accumulates soluble NaCl, $MgCl_2$, $CaCl_2$ salts (FIG. 2B). This selective separation breaks the insoluble calcium sulfate and allows its removal from the salty water. Mixing the two concentrating solutions enables the recovery of calcium sulfate as a precipitate.

Example 3

Aqueous Solubility and Saturation Index of Lanthanum

Figure 3A:
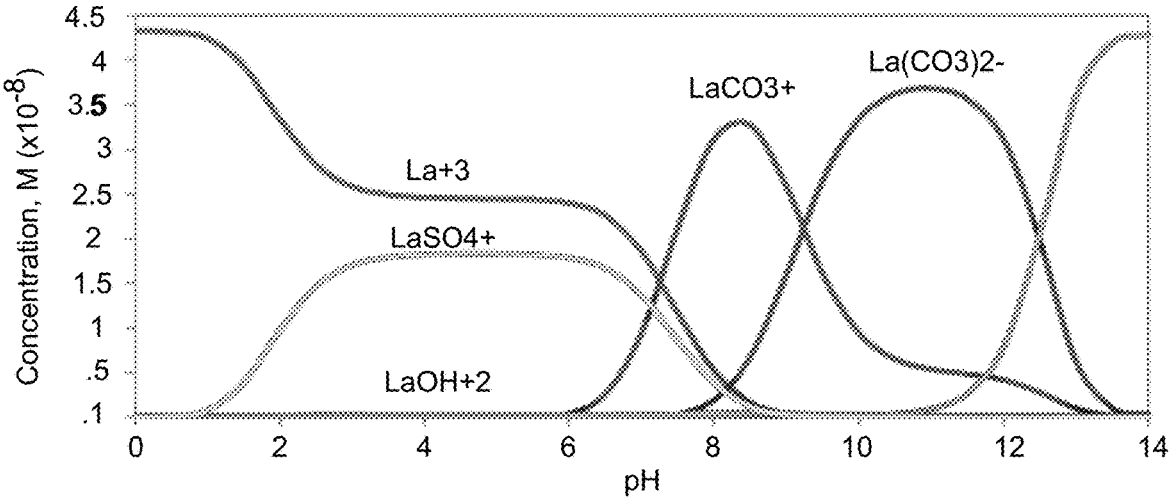
FIGS. 3A-3B show the solubility of lanthanum complexes as a function of pH (FIG. 3A) and the saturation index (FIG. 3B).
Figure 3B:
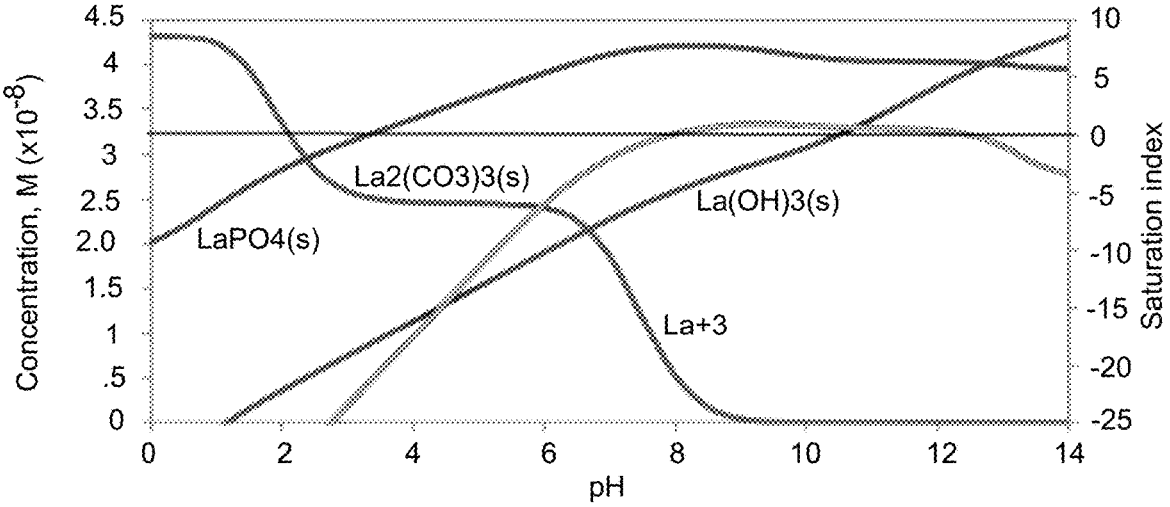

A study to determine the aqueous solubility and saturation index (SI) of lanthanum as a function of pH was conducted using MINTEQ, software. The input concentrations of lanthanum ligands were defined using literature data.[40] The lanthanum saturation index was calculated from the logarithm of the ratio of the ion activity product (IAP) and the solubility constant Ksp.[41,42] The MINTEQ output shows that $LaCO_3^{2-}$ and $LaSO_4^+$ coexist at pH 6-8 (FIG. 3A). It also shows the formation of La phosphate precipitate as the solution pH increases, and the formation of La hydroxide precipitate at high hydroxide concentrations (FIG. 3B).

Metathesis Reaction of REE in the EDM Process

Figure 4:
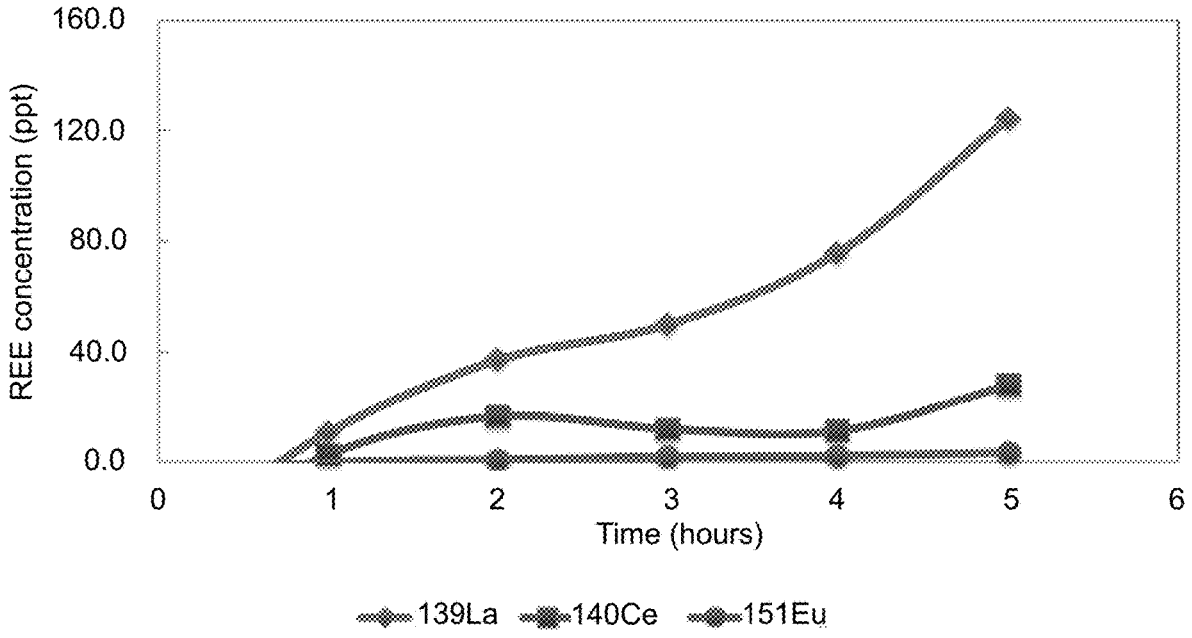
FIG. 4 shows the rare earth element concentration in the EDM mixed-chloride concentrate compartment.
Figure 5:
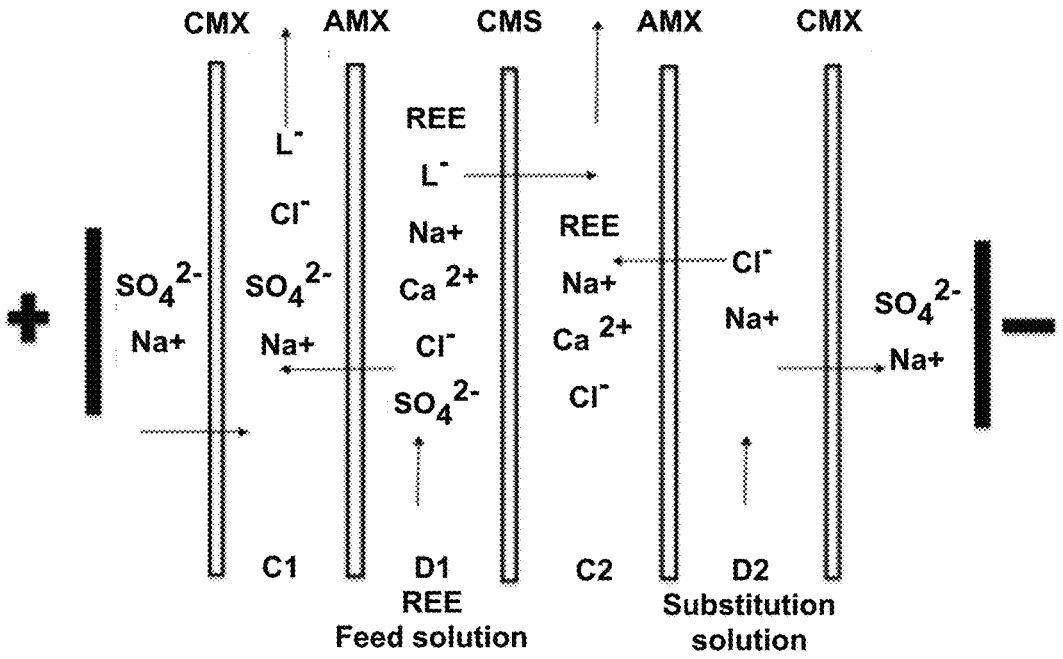
FIG. 5 illustrates the migration of ions during the EDM process when NaCl is the substitution salt solution.

EDM experiments are conducted at different REE feed concentrations, solution pH, applied voltage, and type of substitution solution to investigate the ability of the REE to exchange with minerals naturally present in geothermal water (e.g. NaCl, MgSO4, CaCl2), NaHCO3). Particular emphasis is given to the species $Eu^{2+}$, $La^{3+}$, and $Ce^{4+}$ since they represent multivalent ions. An EDM experimental unit (AMERIDIA Inc.) composed of a steel press stack with a Ti/Pt cathode and a stainless steel anode is used. Initially, NEOSEPTA ion-exchange membranes from TOKUYAMA with one quad and a total area of 0.1 $m^2$ per cell are used. Voltage and current are delivered to the unit with a power supply. Different mineral solutions are added as substitution solution to the EDM unit, including NaCl, Na2SO4, N3PO4, Na2CO3, and NaOH. In each experiment a voltage is applied as a function of time (FIG. 4) to cause the metathesis reaction and selective migration of ions through the ion-exchange membranes towards the corresponding compartments where the REE become concentrated as shown in FIG. 5.

During the metathesis reaction exemplified in FIG. 5 the ions migrate from the feed and substitution solution compartments to the concentrate compartments as follows:

$$(R^{2/3+}L^-)_{D1}+(Na^+Cl^-)_{D2}\rightarrow(R^{2/3+}Cl^-)_{C2}+(Na^+L^-)_{C1},$$

where $L^-$ represents anion group such as $Cl^-$, $SO_4^{2-}$, $CO_3^{2-}$ that form complexes or solids with lanthanum (La), cerium (Ce), and europium (Eu), while $R^{2/3+}$ represents ionic forms of REE. D1, D2, C1, and C2, represent the feed, substitution solution, mixed-sodium, and mixed-chloride compartments, respectively. The concentration of the ions in the feed and concentrate compartments is measured using ICP-MS, IC, and FTIR. Mixing of the two concentrate solution following sequential precipitation with careful adjustment of pH allows recovery of individual REEs.

The effect of the pH on the type of metathesis reaction is studied by adjusting the pH of the feed solution. Characterization of the precipitates is made using SEM/EDS and X-ray analysis. To study the competing effects of the mineral ions on REE recovery, feed solutions containing single REE with single, binary, and ternary mixtures of minerals also are used. EDM experiments are run using simulated samples of geothermal fluids from power plants and wells.

What is claimed is:

1. A process for separating a rare-earth metal of interest from a natural salt-containing water, comprising:

applying an electric field across an electrodialysis metathesis system comprising at least one electrodialysis quad of a feed compartment to receive a salt-containing water, a substitution solution compartment containing a substitution salt solution, a first concentrated compartment, and a second concentrated compartment, each of said compartments in fluid communication via alternating cation- and anion-exchange membranes;

exchanging cations and anions in the natural salt-containing water with cations and anions in the substitution salt solution via a metathesis reaction thereby producing in the first concentrated compartment a first concentrate of a salt composed of cations from the substitution salt solution and anions from the natural salt-containing water and producing in the second concentrated compartment a second concentrate of a salt composed of rare earth metal cations and other cations from the natural salt-containing water and anions from the substitute salt solution;

removing the first concentrate and the second concentrate from the electrodialysis metathesis system and combining the same to produce a combined concentrate; and adjusting pH of the combined concentrate to precipitate the rare earth metal of interest.

2. The process of claim 1, further comprising sequentially readjusting the pH of the combined concentrate to selectively precipitate other metals or salts.

3. The process of claim 2, further comprising recovering the metals or salts.

4. The process of claim 1, wherein producing the first concentrate and the second concentrate simultaneously desalinates the natural salt-containing water in the feed cell; the method further comprising recovering the desalinated water from the feed cell.

5. The process of claim 4, further comprising recovering the desalinated water from the feed cell.

6. The process of claim 1, wherein the rare-earth element is lanthanum, cerium or europium, or a combination thereof.

7. The process of claim 1, wherein the natural salt-containing water is from a geothermal source, is a seawater, a brackish water, a hyper-saline water, is a solution generated from rare earth element-rich ores, or a processed natural liquid from naturally occurring rare earth elements and metal sources or a combination thereof.

8. The method of claim 1, wherein the substitution salt solution comprises a salt or a hydroxide or other solution combination of elements from the Periodic Table of the Elements compatible with a metathesis reaction with a rare earth element or other metal or metalloid.

9. The method of claim 8, wherein the substitution salt solution is a sodium chloride solution, a sodium carbonate solution, a sodium sulfate solution, a sodium hydroxide solution, or a sodium phosphate solution.

10. A process for recovering a rare-earth element of interest from a natural salt-containing water, comprising:

in an electrodialysis metathesis system comprising at least one electrodialysis quad of a feed compartment to receive the natural salt-containing water, a substitution solution compartment containing a substitution salt solution, a first concentrated compartment, and a second concentrated compartment, each of said compartments in fluid communication via alternating cation- and anion-exchange membranes:

feeding the natural salt-containing water into the feed compartment;

applying an electric field across the electrodialysis metathesis system to initiate an exchange of cations and anions in the natural salt-containing water with cations and anions in the substitution salt solution via a metathesis reaction;

concentrating the substitution salt solution cations and the natural salt-containing water anions in the first concentrated compartment and the salt-containing water REE cations and other cations and the substitution salt solution anions in the second concentrated compartment via electrodialysis metathesis;

combining the cations and anions in the first concentrated compartment with the cations and anions in the second concentrated compartment as a combined concentrate;

adjusting pH of the combined concentrate to precipitate the rare-earth element of interest; and recovering the rare earth element from the combined concentrate.

11. The process of claim 10, wherein the concentrating step simultaneously desalinates the natural salt-containing water to produce a desalinated water in the feed cell, the method further comprising:

selectively readjusting the pH of the combined concentrate to sequentially precipitate other rare earth elements contained therein; and recovering the other rare earth elements from the combined concentrate.

12. The process of claim 11, further comprising recovering the desalinated water from the feed cell.

13. The method of claim 10, wherein the rare-earth element is lanthanum, cerium or europium, or other rare-earth element present in the Periodic Table of the Elements or a combination thereof.

14. The process of claim 10, wherein the natural salt-containing water is from a geothermal source, is a seawater, a brackish water, a hyper-saline water, is a solution generated from rare earth element-rich ores, or a processed natural liquid from naturally occurring rare earth elements and metal sources or a combination thereof.

15. The method of claim 10, wherein the substitution salt solution comprises a salt or a hydroxide or other solution combination of elements from the Periodic Table of the Elements compatible with a metathesis reaction with a rare earth element or other metal or metalloid.

16. The method of claim 15, wherein the substitution salt solution is a sodium chloride solution, a sodium carbonate solution, a sodium sulfate solution, a sodium hydroxide solution, or a sodium phosphate solution.

* * * * *